United States Patent [19]

Hermanson

[11] 4,316,414

[45] Feb. 23, 1982

[54] FUZE

[75] Inventor: Gerald P. Hermanson, Maitland, Fla.

[73] Assignee: Dayron Corporation, Orlando, Fla.

[21] Appl. No.: 93,021

[22] Filed: Nov. 9, 1979

[51] Int. Cl.[3] ..... F42C 15/24

[52] U.S. Cl. ..... 102/247; 102/253

[58] Field of Search ..... 102/247, 248, 249, 235, 102/252, 253, 260, 272, 222

[56] References Cited

U.S. PATENT DOCUMENTS

| | | | |
|---|---|---|---|
| 523,110 | 7/1894 | Dungan | 102/252 |
| 1,302,902 | 5/1919 | Davies | 102/252 |
| 1,311,678 | 7/1919 | Cartwright | 102/252 |
| 1,944,780 | 1/1934 | Brandt | 102/253 |
| 2,243,621 | 5/1941 | Denoix | 102/253 |
| 2,378,626 | 6/1945 | Fanger | 102/247 |

FOREIGN PATENT DOCUMENTS

| | | | |
|---|---|---|---|
| 1067341 | 10/1959 | Fed. Rep. of Germany | 102/247 |
| 40639 | 4/1932 | France | 102/253 |

*Primary Examiner*—David H. Brown

*Attorney, Agent, or Firm*—William M. Hobby III

[57] ABSTRACT

A fuze apparatus arms itself in flight and is especially adapted for use in training shells. The fuze has a casing with ignitable or explosive material located therein and an igniter mounted to ignite the ignitable material upon a sufficient impact against the igniter. The fuze is armed in flight by a movable cup moving against the spring bias which moves relative to the fuze casing by inertial force during acceleration, which allows an arming member to slide or roll between the sliding cup and the igniter where it is held until sufficient impact generated by inertial force from a larger mass is directed against the cup, driving the arming member against the igniter.

16 Claims, 4 Drawing Figures

FIG. 1
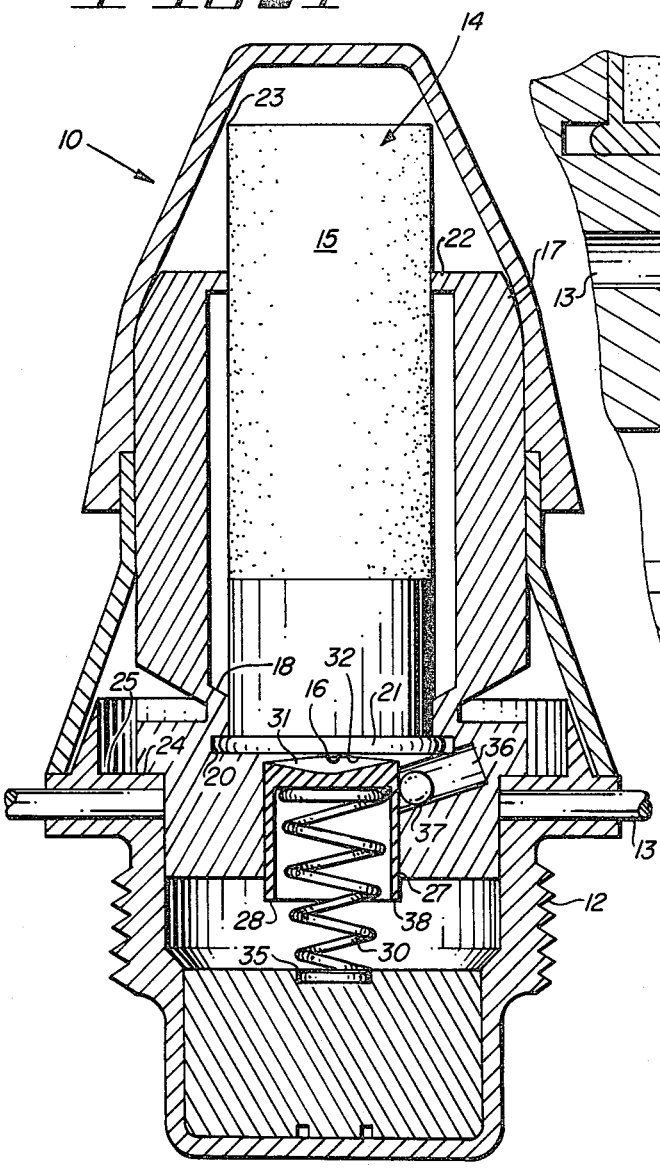
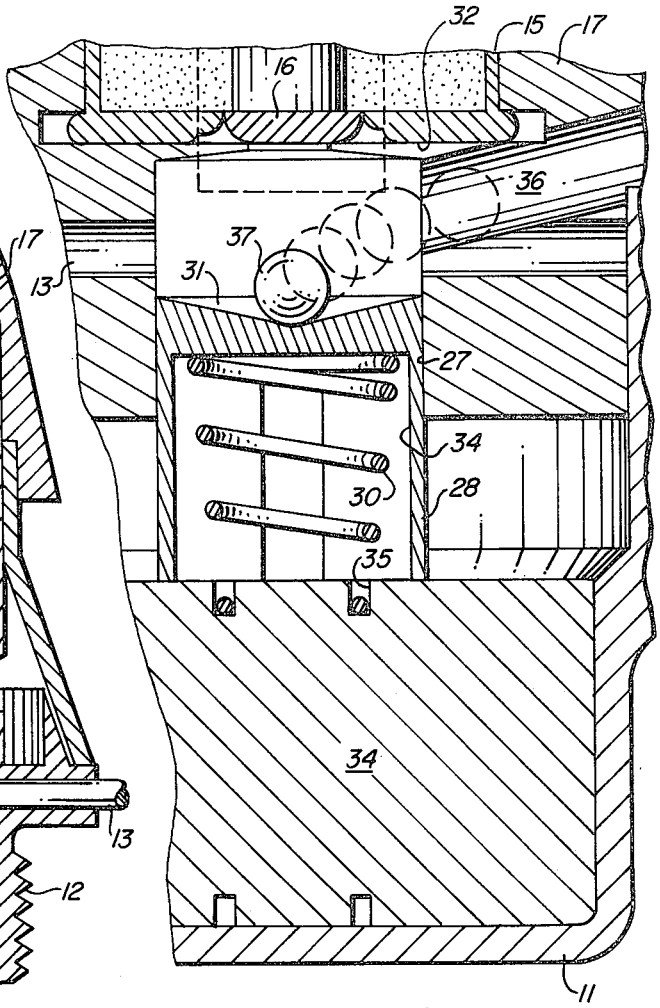
FIG. 3A
FIG. 3B
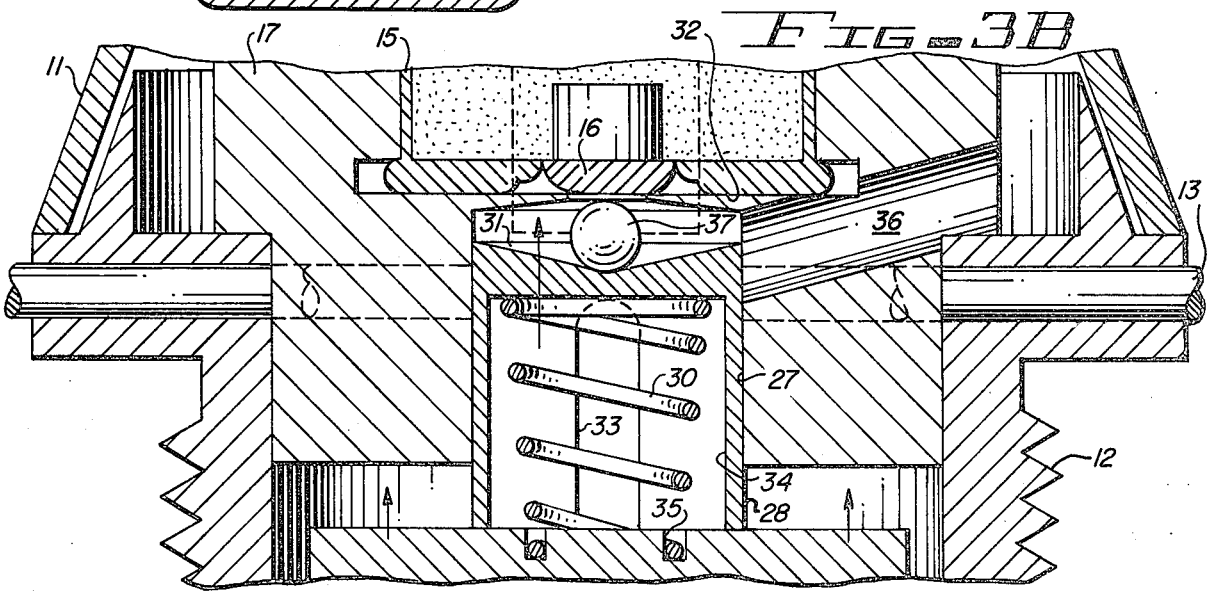

FUZE

BACKGROUND OF THE INVENTION

The present invention relates to a fuze which is armed during flight, which fuze is especially adaptable for use in military training shells.

In the past, a wide variety of fuzes have been used for arming various types of shells, such as mortar shells which fuzes, for safety purposes, are armed during flight. Arming may result from various factors, such as centrifugal force created by the spinning shell, or the like. The present invention is directed toward a fuze which is armed during flight, but which is inexpensively manufactured and ideally suited for training fuzes to avoid the expense of training with more expensive shells. In addition, the cost of the shell can be reduced by the production of less expensive shell bodies for use with the fuze of the present invention. The present fuze has a safety locking pin for locking each fuze until the shell is ready to be fired. The shell is not armed until sufficient acceleration is reached by the shell in flight. Following the arming of the fuze, the fuze is ignited by sufficient deceleration or impact so that the fuze is armed by inertial movement in one direction, and fired by inertial movement of a larger mass in the opposite direction.

SUMMARY OF THE INVENTION

The present invention relates to a fuze apparatus adapted to be attached to a shell, or the like, and includes a fuze casing which may have ignitable materials therein and may have an igniting member mounted in the casing. A movable arming member is supported in a track which guides the movable arming member during movement. A movable firing cup is biased toward the igniting member and is shaped to block the movable arming member from moving into an arming position adjacent the igniting member in one position, and allows the movement of the movable arming member into an arming position when in a second position relative to the fuze casing by the movement of the firing cup against a biasing spring by inertial movement relative to the movement of the fuze casing in flight. The fuze is ignited by the inertial movement of a mass relative to the fuze casing upon rapid deacceleration or on impact of the casing, driving the mass against the movable firing cup and thereby against the movable arming member, and against the igniting member. The fuze is designed for use with a smoke generating shell having an igniter cap on one end which is mounted in a standard fuze casing held in position by a cartridge holding member.

BRIEF DESCRIPTION OF THE DRAWINGS

Other objects, features and advantages of the present invention will be apparent from the written description and the drawings, in which:

FIG. 1 is a sectional view of a fuze prior to arming in accordance with the present invention;

Figure 2:
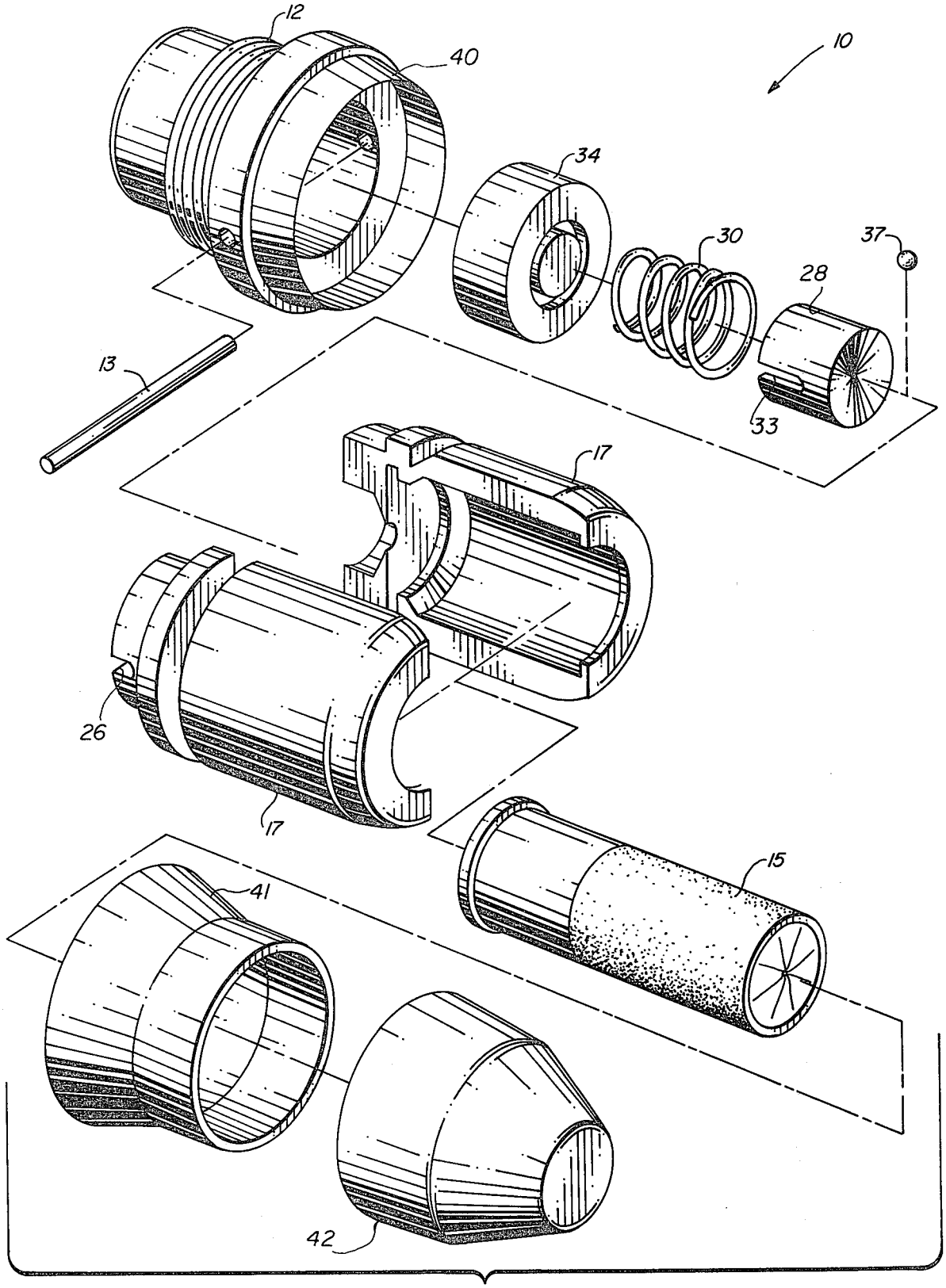
FIG. 2 is an exploded view of a fuze in accordance with the present invention.

FIG. *3a* is a fragmented sectional view of a portion of the fuze being armed; and FIG. *3b* is a fragmented sectional view of the fuze at impact.

DESCRIPTION OF THE PREFERRED EMBODIMENT

Referring now to the drawings, a fuze 10 for training shells has a casing 11 having external threads 12 for attaching to a shell casing. The fuze 10 has a locking or safety pin 13 protruding therefrom and has a cartridge 14 mounted therein. The cartridge 14 may be a shotgun shell having the shot and propellant replaced with a smoke generating chemical, so that a smoke generator is formed having a cartridge sleeve 15 and a primer or ignition cap 16. The cartridge 14 is held within the casing 11 by a split cartridge holder 17 formed to fit against the interior of the casing 11 but having a protruding portion 18 forming an annular slot 20 for holding a rim 21 on one end of the cartridge 14. An annular ledge 22 is formed on the cartridge holder 17 to engage the cartridge 14 sleeve 15, while the sleeve 15 might also be engaged at end 23 to the angled edge of the casing 11. Cartridge holder 17 is split as shown in FIG. 2 so that it may be easily positioned over the cartridge 14 and placed in the casing 11 during assembly. The cartridge holder 17 has a ledge 24 for resting on a ledge 25 of the casing 11 and a slot 26 for the safety pin 13. Cartridge holder 17 also has an annular opening 27 in one end thereof where a cup 28 is slidably mounted and is biased by a spring 30 extending into the cup 28. The cup has an inverted cone surface 31 which prevents the cup 28 from touching the igniter cap 16. Cup 28 has a slot 33 for safety pin 13 to slide through to lock the cup 28 in place. Spring 30 extends from the interior 34 of the cup 28 on one end to a mass 34 on its other end. Mass 34 has a spring holding annular groove 35 therein for holding the spring 30 in position. The cartridge holder 17 has an arming ball track 36 having a spherical ball 37 therein. The track 36 is placed at an angle so that the ball 37 would normally roll against the side of the cup 28 when the fuze 10 is in an upright position. The entire fuze 10 may be mounted in specially made dummy shells, if desired, and would normally be stored as shown in FIG. 1 with the safety pin 13 in place locking the cup 28 in position to prevent the ball 37 from leaving track 36.

In operation, the shell, having fuze 10 mounted therein, has the safety lock pin 13 removed prior to placing the shell in a mortar, howitzer or cannon. However, even with locking pin 13 removed, the ball 37 is held in position in track 36 by the cup 28 which is biased by the spring 30. Once the shell is fired, the acceleration of the fuze 10 in a forward direction pushes the cup 28 against the spring 30 by the inertia of the cup 28, as shown in FIG. *3a*, thereby allowing the spherical arming ball 37 to roll from the track 36 into the inverted cone 31 on the head of the cup 28. The cup 28 returns to its position holding the ball 37 against the igniting cap 16 once the projectile ceases to accelerate, thereby having the fuze 10 armed only in flight. Once the fuze 10 is armed, it will be ignited by the rapid de-acceleration of impact driving the larger mass 34 forward against the spring 30 which in turn drives the cup 28 against arming ball 37 and against the igniter cap 16. The mass 34 engages the rim 38 of the cup 28 as it slams forward, thereby driving arming ball 37 against the cap 16 with great force, igniting the cartridge 14 smoke generator to produce smoke simulative of an actual shell exploding and thereby allowing a training crew to determine the position of the hit. The spring 30 is helically tapered as shown so as to avoid any interference between the spring and the edge of the cup 28 and positioning the annular groove 35 away from the edge 38 during impact.

Training fuze 10 casing 11 might be of identical configuration to the actual fuzes used in the shells, and in fact, the actual shell casing, which can be made of a polymer material, is actually used. The cartridge holding member 17 is made of a molded polymer, such as a molded polyethylene, while the cup 28, the spring 30, the mass 34 and the spherical ball 37 and the locking pin 13 can all be made of steel. An additional advantage is that the shell 15 is already manufactured in production except for the loading with the smoking material, thereby substantially reducing the cost of the training fuze, and allowing it to be used without a shell loaded with high explosives. The casing 11, as seen in FIG. 2, may be in three components, 40, 41 and 42, prior to assembly, to allow for the rapid assembly of the fuze.

It should be clear at this point that a training fuze has been provided which reduces the cost of training military personnel which looks identical to the actual fuzes used in shells and produces smoke to assist in locating where the shell hits. However, other features are contemplated as being within the spirit and scope of the invention. For instance, the mass 34 is shown having an annular groove 35 on both sides thereof, thereby avoiding the mass being placed in the fuze casing 11 upside down. Accordingly, the present invention is not to be construed as limited to the particular forms shown, which are to be considered illustrative rather than restrictive.

I claim:

1. A self-arming fuze comprising in combination:

a fuze casing;

ignitable material located in said fuze casing;

igniting member mounted in said casing for igniting said ignitable material upon receiving a predetermined impact;

movable arming member;

track means for guiding said movable arming member during movement; and movable firing member biased toward said igniting member, said movable firing member having means to block said movable arming member from moving into an armed position when said movable firing member is in one position and allowing the movement of said movable arming member into an armed position when in a second position, movement of said movable firing member against said biasing means being inertial movement relative to movement of said fuze casing in flight, whereby said fuze is armed during flight.

2. A self-arming fuze in accordance with claim 1, in which said ignitable material located in said fuze casing is a smoke generating material.

3. A self-arming fuze in accordance with claim 2, in which said ignitable material is located in a cartridge casing having said igniting member mounted on one end thereof.

4. A self-arming fuze in accordance with claim 3, in which a cartridge casing holding means locks said cartridge casing in position in said fuze casing.

5. A self-arming fuze in accordance with claim 4, in which said cartridge casing holding means is a split casing for fitting over said cartridge and shaped to hold said cartridge therein when said cartridge is mounted in said fuze casing.

6. A self-arming fuze in accordance with claim 5, in which said fuze casing has an aperture through the side thereof and said cartridge casing holding member and movable firing member have slots therein for receiving a locking pin for locking said movable firing member in said one position.

7. A self-arming fuze in accordance with claim 6, in which said track means is formed in in said cartridge casing holding member and forms an angular passageway therein.

8. A self-arming fuze in accordance with claim 7, in which said movable firing member includes a movable cup being spring biased toward said cartridge mounted in said fuze casing and having a shaped head on said cup.

9. A self-arming fuze in accordance with claim 8, in which said movable firing member specially shaped head is an inverted cone shape for holding said moving armable member in place, and said movable arming member is a generally spherical shaped member for rolling from said track means onto said movable cup-shaped head when said movable firing member is in said second position.

10. The self-arming fuze in accordance with claim 9, in which a mass is mounted in said fuze casing on the other end of said spring biasing means of said movable firing member and is adapted for inertial movement in said fuze casing upon rapid deceleration to drive said movable firing member cup against said movable arming member and into said igniting member, thereby igniting said cartridge and ignitable material to produce smoke.

11. A self-arming fuze in accordance with claim 10, in which said mass is grooved to receive one end of said movable firing member biasing spring therein.

12. A self-arming fuze in accordance with claim 11, in which said mass has a spring groove on both sides thereof and has a generally cylindrical shape.

13. The apparatus in accordance with claim 12, in which said spring is a narrowing angled helical spring angled to said groove located in said mass from an opening in said movable firing member cup for holding said spring on the other end thereof.

14. A fuze comprising in combination:

a fuze casing;

a cartridge member having an ignitable material therein, and an igniting cap mounted on one end thereof for igniting said ignitable material upon receiving a predetermined impact;

a cartridge holding member for holding said cartridge member in said fuze casing, said cartridge holding member having a track therein;

a movable arming member located in said track in said cartridge holding member;

a sliding member biased toward said cartridge member and blocking the movement of said movable arming member to an arming position in front of said movable firing member, whereby acceleration will force said sliding movable firing member against said spring allowing said movable arming member to be positioned in front of said sliding firing member whereby said fuze may be armed during flight.

15. The fuze in accordance with claim 14, including a mass mounted for movement upon rapid deceleration to drive said sliding member into said arming member and into said igniting cap upon the rapid deceleration of impact.

16. The fuze in accordance with claim 15, in which a locking pin slides through said fuze casing through said cartridge holding member and through said sliding member to lock the sliding member in place to prevent said movable arming member from moving into position until said locking pin is removed.

* * * * *